United States Patent [19]

Johnson

[11] 4,159,016

[45] Jun. 26, 1979

[54] FREESTANDING FIREPLACE STOVE WITH COOKING MEANS

[75] Inventor: Michael Johnson, Santa Cruz, Calif.

[73] Assignee: Chinook Manufacturing Co., Santa Cruz, Calif.

[21] Appl. No.: 831,776

[22] Filed: Sep. 9, 1977

[51] Int. Cl.[2] ..... F24B 7/00

[52] U.S. Cl. ..... 126/120; 126/137

[58] Field of Search ..... 126/120, 121, 143, 130, 126/131, 135, 136, 140, 141, 142

[56] References Cited

U.S. PATENT DOCUMENTS

| | | | |
|---|---|---|---|
| 140,543 | 7/1873 | Robb | 126/137 |
| 1,451,246 | 4/1923 | Wetzel | 126/137 |
| 1,470,542 | 10/1923 | Poling | 126/140 |
| 3,169,516 | 2/1965 | Agnese | 126/121 X |
| 4,060,068 | 11/1977 | Lever et al. | 126/120 |
| 4,068,649 | 1/1978 | Johnson | 126/120 |
| 4,074,679 | 2/1978 | Jensen | 126/131 X |

*Primary Examiner*—Dennis L. Taylor

*Attorney, Agent, or Firm*—Robert G. Slick

[57] ABSTRACT

A freestanding fireplace stove is provided with an air space surrounding the firebox which is heated by the fireplace and is provided with doors and shelves so that the fireplace may be used as an oven. Further, the top of the fireplace has a large flat area which may be used as a cooking stove.

4 Claims, 2 Drawing Figures

FREESTANDING FIREPLACE STOVE WITH COOKING MEANS

SUMMARY OF THE INVENTION

In co-pending patent application Ser. No. 685,453 filed May 12, 1976, now U.S. Pat. No. 4,068,649, there is described and claimed a freestanding fireplace stove wherein the combustion air passes under the bottom of the combustion chamber to keep the bottom of the fireplace unit cool. The claimed fireplace is so well insulated that it may be installed directly on a rug without the use of a hearth.

The present invention is an improvement over my prior structure in that a space or plenum is provided between the outer walls of the fireplace and the firebox which is provided with shelves and one or more doors so that the fireplace may be utilized as an oven. Further, at least a portion of the top of the fireplace has a horizontal, flat surface which may be utilized as an ordinary stove.

A further improvement of the present invention over my prior structure is that the firebox itself is made from welded stainless steel sections having stiffener channels thereon and it is not necessary to surround the firebox with insulating material, which further results in the better utilization of fuel.

Other objects and advantages of the invention will be described in the balance of the specification.

BRIEF DESCRIPTION OF THE DRAWINGS

In the drawings forming a part of this application.

DESCRIPTION OF THE PREFERRED EMBODIMENTS

Figure 2:
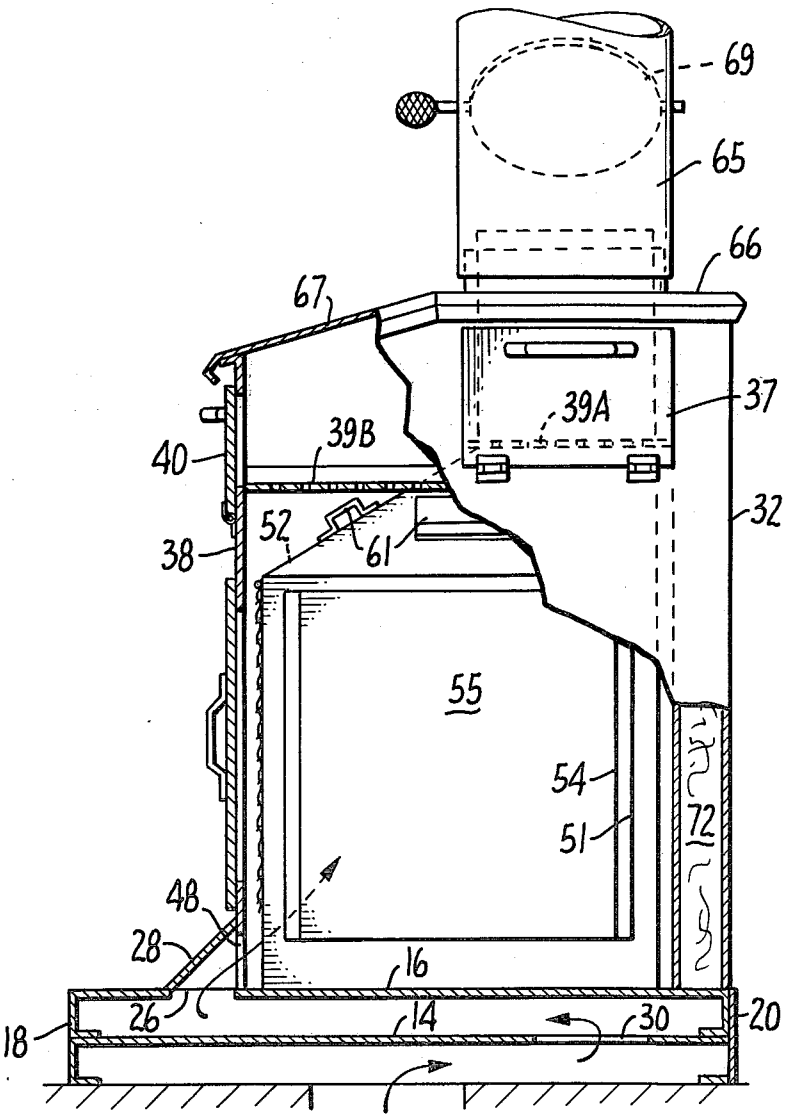
FIG. 2 is a side sectional view of the fireplace.
Figure 1:
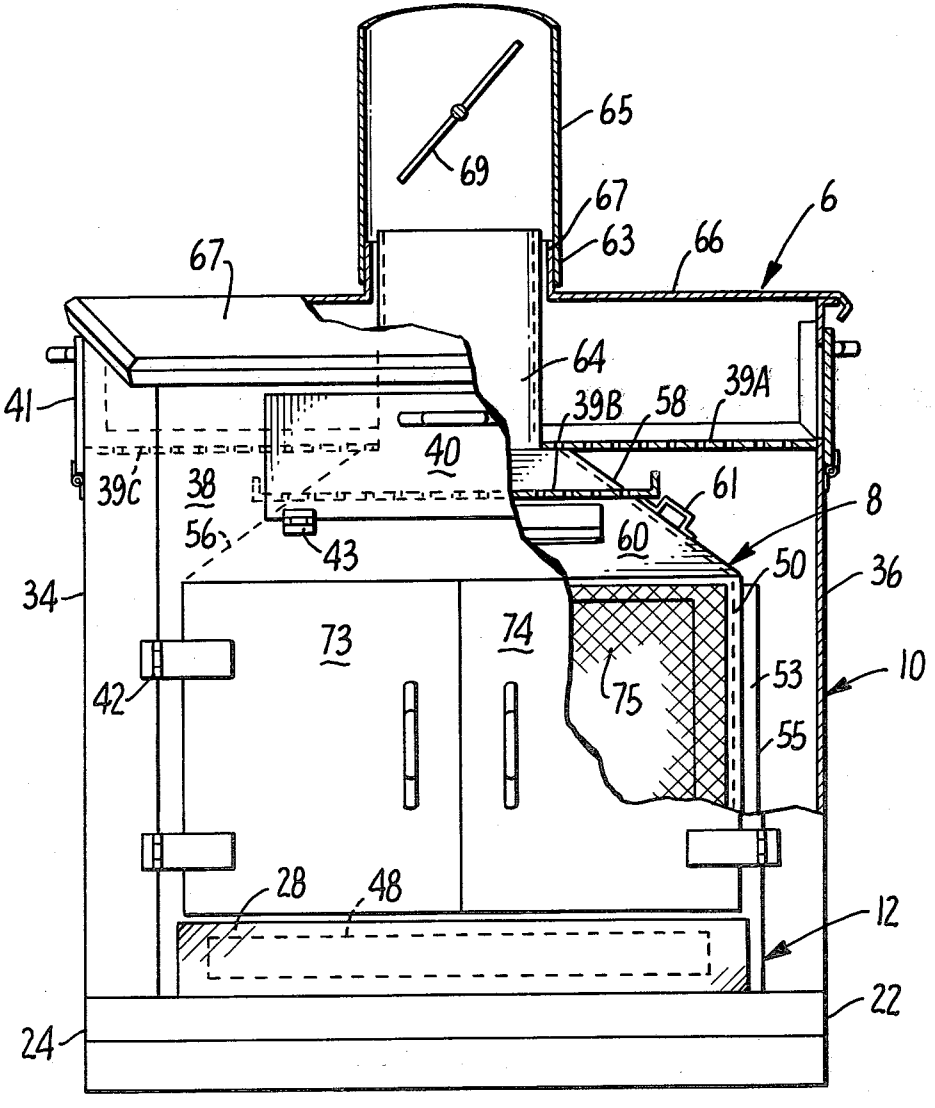
FIG. 1 is a front view of a fireplace embodying the present invention with certain of the parts cut away.

Referring now to the drawings by reference characters, the fireplace of the present invention includes four major parts, namely, a top 6, a firebox 8, and outer shell 10 and a base 12.

The base 12 is substantially like that of my prior patent and includes an intermediate plate 14, a top plate 16, front and back members 18 and 20, and side members 22 and 24. The top plate 16 has an opening 26 over which is the deflector assembly 28. The bottom of the base is open as can best be seen in FIG. 2 and combustion air flows into the bottom of the base, then toward the back under plate 14, and then upward through opening 30 in plate 14 where the air flows to the front of the fireplace. The combustion air then flows upward through opening 26 and is directed by deflector assembly 28 into the combustion zone of the firebox 8 through openings 48.

The outer shell 10 has a back wall 32, side walls 34 and 36, and a front wall 38. The wall also supports sockets 42 for the firebox doors 73 and 74 as well as sockets 43 for the front oven door 40. The side wall 36 also has a door 37 while wall 34 has a door 41. Shelves 39A, B and C of perforated metal are opposite doors 37, 40 and 41 respectively and are supported by the outer shell 10. Thus to use the device as an oven, the items to be cooked can be placed on the shelf 39 by utilizing the oven doors 37 or 40. Although two doors have been shown, it is obvious that a smaller or larger number of doors might be employed. The front wall 38 has openings 48 which mate with the deflector assembly 28 so that air is directed into the combustion zone when the fireplace is assembled.

The firebox itself, generally designated 8, is made of welded stainless steel and does not require insulation at the sides and back as in the previously referred to structure. Thus, the firebox has side walls 50 and 52 and a back wall 54. The top is formed by the sloping members 56, 58 and 60 which mate with the top of back wall 54. At the top is the pipe 64 for conveying the combustion products through the flue 65. The top plate 6 has a stub pipe 63 which forms a tight connection with the flue 65 but it will be seen that there is a slight space 67 between pipe 64 and pipe 63. Flue 65 is provided with a damper 69 and the temperature of the oven is controlled by opening or closing the damper.

Top plate 6 has a flat rear portion 66 and one may place a pan or skillet on this surface as one would an ordinary stove. The front portion of the top slopes downwardly at 67 to meet with the front plate 38.

The back wall of the firebox is provided with a plurality of stiffening flanges 51 which are shaped somewhat like the letter Z and welded in place. Similar flanges 53 are provided on the side walls. Flanges 61 serve to stiffen members 56, 58 and 60. In addition, the side walls may have shields 55 which are mounted over the stiffening flanges. These shields are open at the top and bottom to permit air to circulate upwardly through them but they prevent the outer shell 10 from getting unduly hot from heat radiated by the firebox.

Insulation 72 is provided on the back wall of the outer shell so that the fireplace can be mounted directly against a wall. As can best be seen in FIG. 2, this insulation is placed a substantial distance from the firebox proper so that air can circulate along the back wall of the fireplace.

Doors 73 and 74 are hinged on the outer shell 10. The firebox 8 fits tightly against the shell 10 at the front of the fireplace so there is no mixing of the combustion air and the air circulated in the plenum formed between the firebox and the outer shell. Sliding screen 75 is provided for use when the doors are open.

Since there is always some slight leakage of circulating air through the shell, a small amount of air will be brought into the plenum formed between the firebox and the outer shell and will be discharged through the small opening 67 between the pipes 64 and 65. Food placed on the shelf 39 will be baked or roasted and the top surface 66 can be used in the manner of an ordinary stove. Doors 37 and 40 can be left open when not baking if it is desired to heat a room.

It is believed apparent in the foregoing that I have provided an efficient stove-fireplace which is particularly adapted for use in mobile homes without clearance and without the necessity of insulation under the fireplace and which can be utilized in the cooking of food.

I claim:

1. A freestanding air circulating fireplace stove comprising, in combination:
   a. an all metal, uninsulated firebox having two side walls, a back wall and a top wall defining a combustion chamber having an open front, said side and back walls being imperforate;
   b. an outer shell completely surrounding said firebox and spaced therefrom to form plenum chambers opposite said side, back and top walls of the firebox;

c. a combustion air inlet in said outer shell opposite the open front of the combustion chamber of the firebox for admitting combustion air thereto;

d. a flue for the exhaust of combustion products;

e. an outlet for combustion products in said top wall of the firebox in communication with said flue;

f. means communicating said plenum chambers with said flue;

g. shelf means in said plenum chambers, and h. access means in said outer shell granting ingress and egress to said shelf means.

2. The combination set forth in claim 1 wherein said side walls of the firebox are provided with heat shields to prevent the plenum chambers opposite said side walls from becoming unduly hot.

3. The combination set forth in claim 2 wherein said side, back and top walls of said firebox are provided with stiffening members.

4. The combination set forth in claim 3 wherein said outer chamber is provided with closure means for selectively opening or blocking off the open front of the firebox.

* * * * *